US005310244A

United States Patent [19]

Borgardt

[11] Patent Number: 5,310,244

[45] Date of Patent: May 10, 1994

[54] LAPBOARD/PATIENT RESTRAINT DEVICE

[76] Inventor: Alvin G. Borgardt, 3124 N. Van Ness, Fresno, Calif. 93704

[21] Appl. No.: 831,179

[22] Filed: Feb. 5, 1992

[51] Int. Cl.[5] ..... A47C 7/68

[52] U.S. Cl. ..... 297/153; 297/487; 297/DIG. 4; 297/148

[58] Field of Search ..... 297/135, 148, 153, 487, 297/488; 108/43, 44

[56] References Cited

U.S. PATENT DOCUMENTS

| | | | |
|---|---|---|---|
| 1,232,089 | 7/1917 | Riebe | 108/43 |
| 1,520,085 | 12/1924 | Rossiter, Jr. | 108/43 X |
| 2,720,913 | 10/1955 | Hoppert | 297/153 X |
| 3,515,429 | 6/1970 | Bollinger | 297/153 |
| 3,541,976 | 11/1970 | Rozas | 108/43 |
| 4,770,107 | 9/1988 | Miller | 106/44 |
| 4,795,210 | 1/1989 | Milat | 108/43 |
| 4,854,638 | 8/1989 | Marcus et al. | 297/250 |
| 4,872,723 | 10/1989 | Kopf | 297/216 |
| 5,106,156 | 4/1992 | Marquis | 297/153 |

FOREIGN PATENT DOCUMENTS

| | | | |
|---|---|---|---|
| 263452 | 12/1926 | United Kingdom | 108/43 |

*Primary Examiner*—Peter R. Brown
*Attorney, Agent, or Firm*—David J. Larwood

[57] ABSTRACT

A lapboard is adapted to be fitted to a chair with two arms, where the lapboard is a generally flat surface with a cleat positioned to generally parallel to and close one arm of the chair and a second cleat positioned generally parallel to and close to the other arm of the chair, plus securing means for securing the lapboard to the chair. The lapboard is secured by one or two straps connected to the rear right and left of the lap board and looped around behind the occupant of the chair, preferably fastened by a quick release clip. A second strap connected to the front right and left of the lapboard can be looped around the arms to secure the front of the lapboard.

2 Claims, 3 Drawing Sheets

LAPBOARD/PATIENT RESTRAINT DEVICE

FIELD OF THE INVENTION

The device of this invention is a lapboard principally designed for use in conjunction with a chair, particularly a wheelchair. It is useful in hospitals, nursing homes and other patient care environments.

BACKGROUND OF THE INVENTION

Patients in chronic care facilities often are maintained in a chair for extended periods of time. Many chairs used for patient care can be fitted with a lapboard, which functions basically as a table to support a tray of food, reading materials, handicrafts, etc.

Lapboards used in the past have been designed to clip around the arms of a chair or wheelchair, snap onto a chair or wheelchair or to otherwise/securably fasten to a wheelchair.

SUMMARY OF THE INVENTION

The present invention is a lapboard which can be fixably mounted on a chair such as a wheelchair. The mounting includes means for securing on the right and left arms of the chair.

DETAILED DESCRIPTION

Figure 1A:
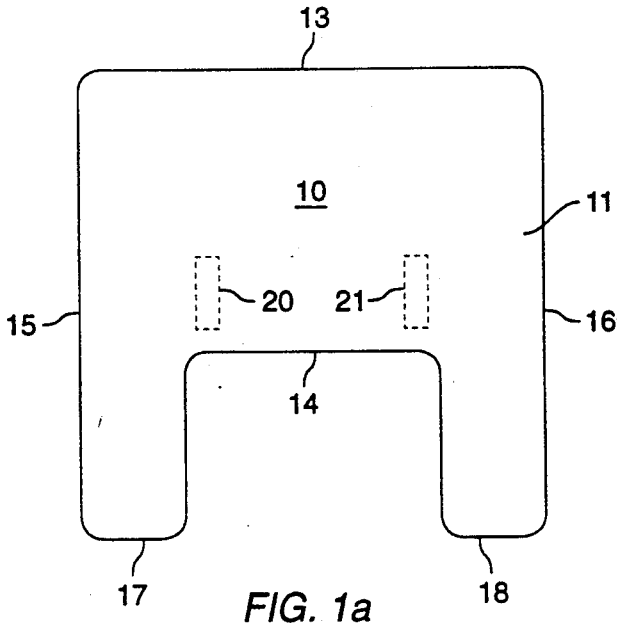
FIG. 1(a) illustrates a top view of the lapboard of the present invention.
Figure 1B:
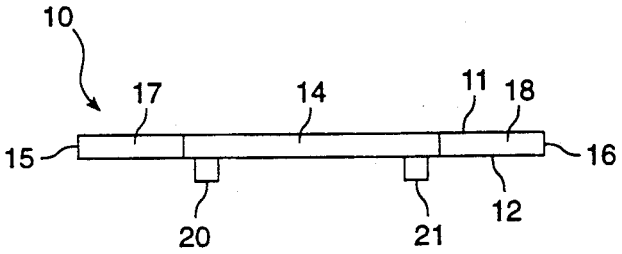
FIG. 1(B) illustrates an edge view of the lapboard of the present invention.

The lapboard device of the present invention may consist of tray 10, generally in the shape illustrated in FIG. 1. Tray 10 has top 11, bottom 12, front 13, back 14, left side 15, right side 16, left arm extension 17 and right arm extension 18. The lapboard device presents a relatively horizontal surface 11 for a person sitting in a chair. Left cleat 20 and right cleat 21 are attached to bottom 12.

Figure 2:
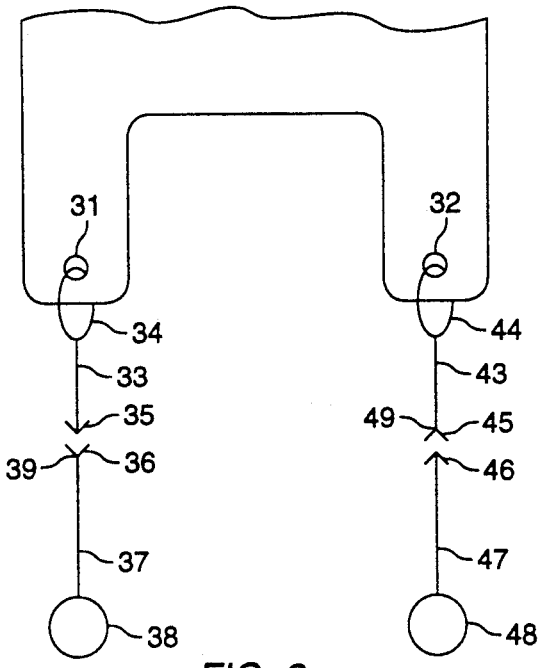

Referring to FIG. 2, left arm extension 17 includes hole 31 through which strap 33 is passed. The strap is preferably secured to itself, for example by sewing or with a clip, to form loop 34 which passes through hole 31. Similarly, strap 43 passes through hole 32 in right arm extension 18 to form loop 44. Straps 33 and 43 can be fastened by a number of means. In a preferred form of the invention, strap 33 is secured to inner fastener 35. One end of extension strap 37 is adjustably attached to outer fastener 36, leaving loose end 39. The other end of extension strap 37 terminates in loop 38. Similarly, strap 43 is attached to outer fastener 45 leaving loose end 49. One end of extension strap 47 is attached to inner fastener 46 and the other end is terminated by loop 48.

Figure 4:
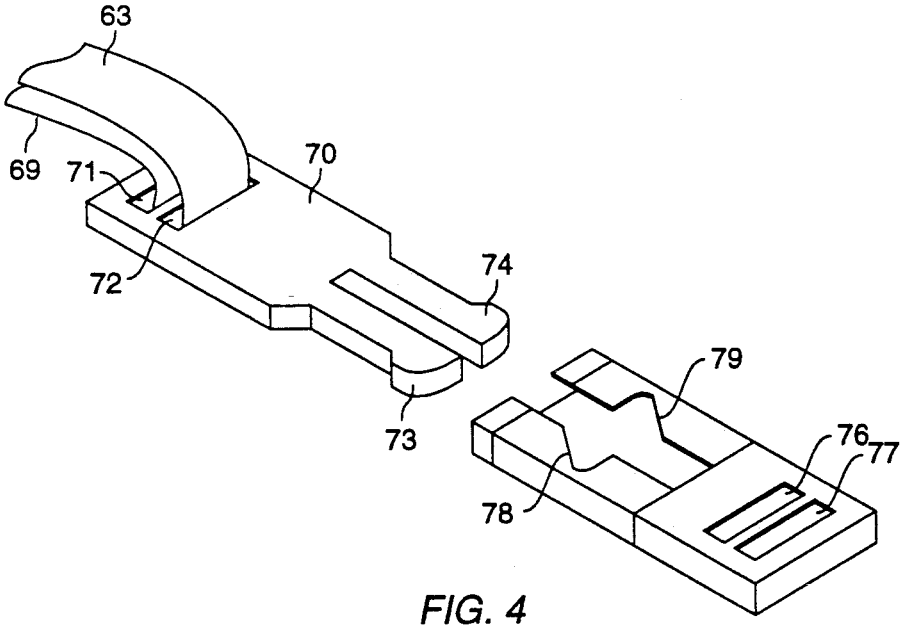
FIG. 4 illustrates fastening clips.

One type of fastener is illustrated in FIG. 4, including inner fastener 70 and outer fastener 75. Channels 71 and 72 in inner fastener 70 are designed to accommodate strap 63 and loose end 69. Loose end 69 can be shortened or lengthened in the typical manner to adjust the length of strap 63. Clip portions 73 and 74 of inner fastener 70 are designed to fit into detents 78 and 79 in outer fastener 75. This allows for secure fastening yet easy detachability. Channels 76 and 77 in outer portion 75 are designed to accommodate another strap, not shown.

Figure 5:
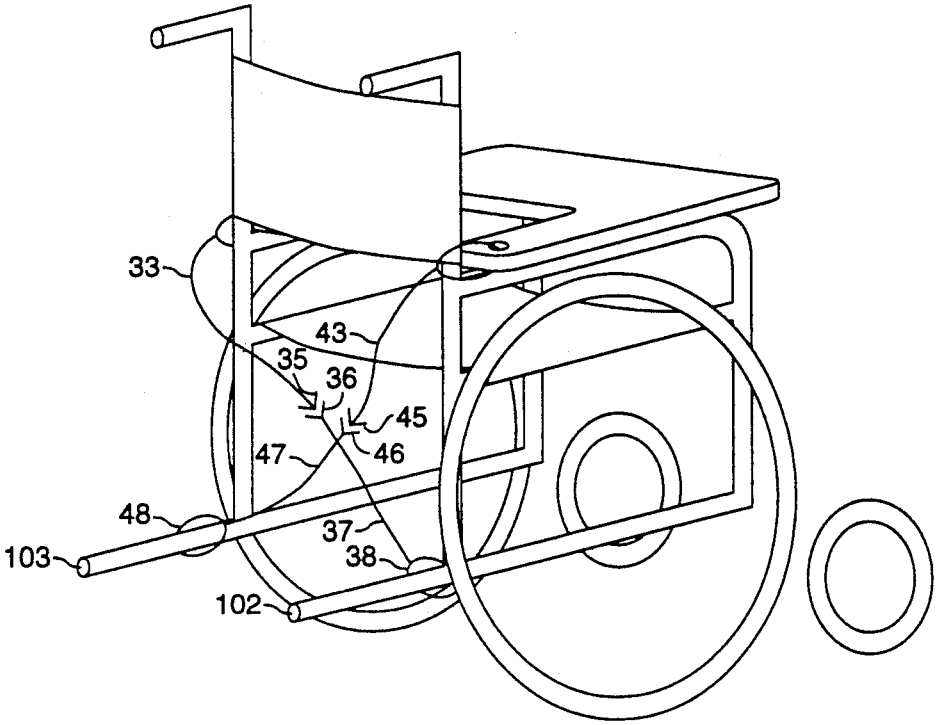
FIG. 5 illustrates the lapboard secured to a wheelchair using the principal straps.

Referring to FIG. 5, loop 38 can be placed around a suitable fastening point, such as rail extension 102 of a wheelchair. Similarly, loop 48 is passed around rail extension 103. Loop 38 is thus connected through strap 37, outer connector 36, inner connector 35, and strap 33 to hole 31 (not illustrated in FIG. 5) to secure lapboard 10 to rail extension 103. Similarly, loop 48 is connected through strap 47, outer connector 46, inner connector 45 and strap 43 to hole 32 to secure lapboard 10 to rail extension 103. Loose ends 39 and 49 can be tightened so the lapboard is secured around the occupant of a chair. A quick release fastener allows easy release of the lapboard. Alternative means of fastening are readily apparent to one skilled in the art. For example, strap 33 can be connected to strap 43 through inner fastener piece 35 and outer fastener piece 45. The straps could be simply passed directly behind the patient and secured at that point, still providing the advantage of secure fastening with the option of quick release. The clips in either configuration are readily accessible to a health care provider but are generally out of reach of the occupant of the chair.

Figure 3:
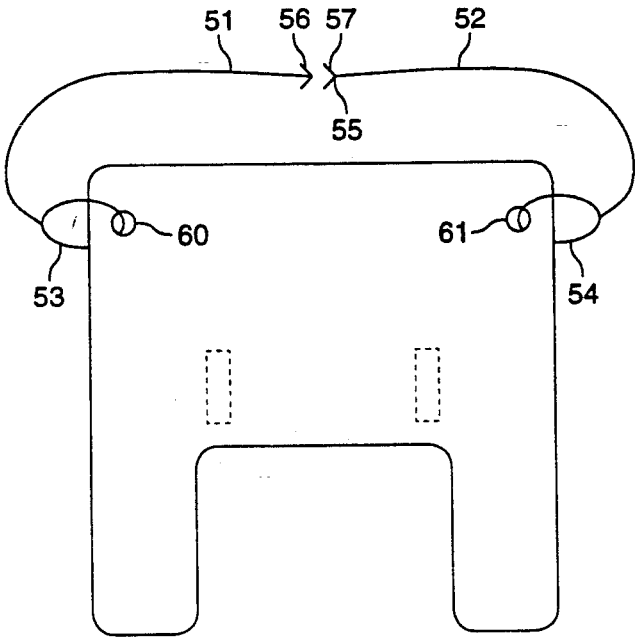
FIG. 3 illustrates the lapboard of the present invention with additional straps at the front of the lapboard.
Figure 6:
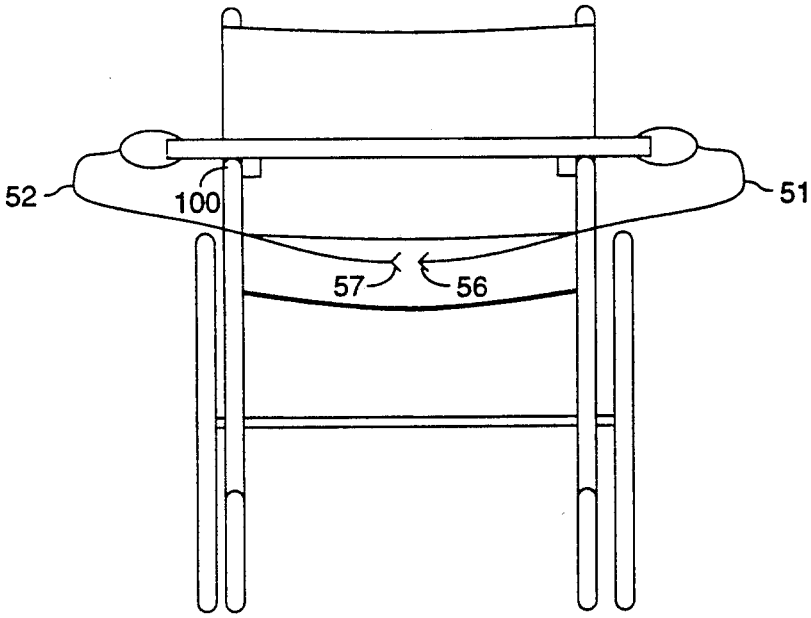
FIG. 6 illustrates the lapboard secured to a wheelchair using the front straps.

The functioning of the lapboard can be improved by securing the front portion of the lapboard so that it cannot readily lift up. Referring to FIG. 3, strap 51 is passed through hole 60 in the front left portion of lapboard 10 to form loop 53. Strap 52 is passed through hole 61 in the front right portion of the lapboard to form loop 54. Straps 51 and 52 can be connected through inner fastener 56 and outer fastener 57 and tightened using loose end 55 of strap 52. Referring to FIG. 6, lapboard 10 resting on a chair's right arm rest 100 and left arm rest 101 can be secured by passing strap 51 around arm rest 101 and strap 52 around arm rest 100 and connecting inner fastener 56 to outer fastener 57 approximately above the patient's knees. This will allow the front of the lapboard to be effectively maintained in a generally horizontal orientation. The position of the fastener relative to the occupant of the chair can be adjusted to be relatively inaccessible to the occupant.

As will be understood by those skilled in the art, many changes in many aspects of the device described above may be made by the skilled practitioner without departing from the spirit and scope of the invention, which should be limited only as set forth in the claims which follow.

What is claimed is:

1. In the combination of a lapboard and a chair, a combination comprising a lapboard fitted to a chair, said chair having two arms and a first and a second fixed portion, and said lapboard having a top and a bottom, the improvement comprising:

a first cleat secured to said lapboard and positioned below said lapboard to be generally parallel to and close to a first arm of said chair; and a second cleat secured to said lapboard and positioned below said lapboard to be generally parallel to and close to a second arm of said chair; and securing means connected to said lapboard and configurable to wrap around some portion of said chair, thereby securing said lapboard to said chair with each of said first and second cleats positioned generally close to said first and second chair arms, respectively, said securing means including:

a left extension to said lapboard connected to and extending generally rearwardly from said lapboard, said extension having a left hole generally near the back of said left extension;

a right extension to said lapboard connected to and extending generally rearwardly from said lapboard, said extension having a right hole generally near the back of said right extension;

a left strap having two ends with a first end connected to said left hole;

a right strap having two ends with a first end connected to said right hole;

means for securing said left strap and said right strap to secure said lapboard to said chair such that an occupant of said chair cannot access or operate said means for securing; said means for securing said left strap and said right strap including;

a loop on the second end of said left strap adapted to fit around a first fixed portion of said chair; and a loop on the second end of said right strap adapted to fit around a second fixed portion of said chair.

2. The combination lapboard and chair of claim 16 wherein said lapboard includes a left front hole and a right front hole, further comprising front securing means connected to said lapboard and configurable to wrap around some portion of said chair for securing the front portion of said lapboard to said chair, said front securing means including:

a left front strap having two ends with a first end connected to said left front hole;

a right front strap having two ends with a first end connected to said right front hole.

* * * * *